US008437687B2

(12) United States Patent
Chowdry et al.

(10) Patent No.: US 8,437,687 B2
(45) **Date of Patent: *May 7, 2013**

(54) CALCULATING BOOKLET SHEET LENGTH USING TONER THICKNESS

(75) Inventors: Arun Chowdry, Pittsford, NY (US); Thomas N. Tombs, Rochester, NY (US); Brian J. Kwarta, Pittsford, NY (US); Donald S. Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 409 days.

This patent is subject to a terminal disclaimer.

(21) Appl. No.: 12/770,095

(22) Filed: Apr. 29, 2010

(65) Prior Publication Data

US 2011/0266737 A1 Nov. 3, 2011

(51) Int. Cl.
*G03G 15/00* (2006.01)

(52) U.S. Cl.
USPC ..... 399/408; 412/16; 493/324

(58) Field of Classification Search ..... 399/407, 399/408, 409, 410; 412/1, 16, 18, 32; 493/324, 493/340, 361
See application file for complete search history.

(56) References Cited

U.S. PATENT DOCUMENTS

| | | | | |
|---|---|---|---|---|
| 6,099,225 | A | 8/2000 | Allen et al. | |
| 7,095,526 | B1 | 8/2006 | Housel | |
| 7,946,565 | B2 * | 5/2011 | Kubota et al. | 270/39.01 |
| 2005/0079968 | A1 | 4/2005 | Trovinger | |
| 2007/0035081 | A1 * | 2/2007 | Kaneko et al. | 270/58.09 |
| 2008/0252062 | A1 | 10/2008 | Kelley | |

FOREIGN PATENT DOCUMENTS

| | | |
|---|---|---|
| EP | 0 992 365 A1 | 4/2000 |
| JP | 09-110051 | 4/1997 |
| JP | 2006058392 | 3/2006 |
| WO | WO0178975 | 10/2001 |

OTHER PUBLICATIONS

MBM Corp. web site, Auto BookletMaker Instruction Manual http://www.mbmcorp.com/pdfs/br_0846.pdf, Oct. 26, 2010.

(Continued)

*Primary Examiner* — Ren Yan
(74) *Attorney, Agent, or Firm* — Christopher J. White

(57) ABSTRACT

A booklet is produced including an outer sheet and an inner sheet folded and nested together. A print image having a thickness is printed where it is between the two sheets when they nest together. A cut length is calculated using the thicknesses of the sheets and the thickness of the print image, so that when the sheets are folded and the inner sheet is nested into the outer sheet, the edges of the inner sheet will not protrude beyond the edges of the outer sheet. The inner sheet is cut to the calculated cut length either before or after printing. The cut inner sheet and the outer sheet are folded and nested together to produce the booklet.

9 Claims, 10 Drawing Sheets

OTHER PUBLICATIONS

PL265 Fully Automatic Programmable Cutter, Martin Yale Industries website: http://www.martinyale.com/product_details.aspx?SKU=Intimus%20PL215%20&ReturnURL=%2fproduct_listing.aspx%3fCategory%3d1579e4d1-c382-461a-9de0-453e7a74e279%26page%3d1%26pagesize%3d10%26text%3d%26EPCString1%3d%26EPCString2%3d%26EPCString3%3d, Apr. 28, 2010.

P7400 Autofolder, Martin Yale Industries web site: http://www.martinyale.com/product_details.aspx?SKU=Martin%20Yale%20P7400&ReturnURL=%2fproduct_listing.aspx%3fCategory%3dd15cdba3-f886-4d69-84f9-cbfcaccee83c%26page%3d1%26pagesize%3d10%26text%3dp7400%26EPCString1%3d%26EPCString2%3d%26EPCString3%3d, Apr. 28, 2010.

Cricut Personal Electronic Cutter, Provo Craft on line user manual: http://www.cricut.com/res/mManual/CricutUserManual.pdf, Apr. 29, 2010.

* cited by examiner

CALCULATING BOOKLET SHEET LENGTH USING TONER THICKNESS

CROSS-REFERENCE TO RELATED APPLICATIONS

Reference is made to commonly assigned, co-pending U.S. patent application Ser. No. 12/770,077 (96210), filed concurrently herewith, entitled "PRODUCING BOOKLET BY CUTTING BEFORE PRINTING," by Chowdry, et al., the disclosure of which is incorporated by reference herein.

FIELD OF THE INVENTION

This invention pertains to the field of finishing printed sheets to produce booklets, and more particularly to such printed sheets produced using electrophotography.

BACKGROUND OF THE INVENTION

Customers of print jobs can require finishing steps for their jobs. These steps include, for example, folding printed or blank sheets, cutting sheets, trimming sheets to size and shape, cutting specialty shapes into the edges or interior of a sheet, forming multiple sheets into bound signatures or booklets, binding individual pages or signatures into books, and fastening covers to books by e.g. stapling, saddle-stitching, or gluing. Signature production requires folding a large printed sheet and cutting the folded stack so that the resulting cut pages are in sequential order.

When producing a booklet or signature, after binding, the edges of the bound printed sheets are cut so that the edges of the individual sheets all line up (have a flush edge), as commonly seen in books, magazines, and pamphlets. When producing business cards, the cards are printed on a large sheet of stiff card stock. After printing, individual cards are produced by cutting the sheets of cards into individual business cards.

Conventional finishing equipment is typically not suited for use in consumer occupied environments such as stores or business establishments, and typically requires trained personnel to safely and effectively use it. Cutters typically include large guillotines that use heavy impacts to cut through thick stacks of paper. For example, the INTIMUS PL265 programmable cutter by MARTIN YALE of Wabash, Ind. cuts up to a 2⅞" stack of paper and weighs 823 lbs. There is a need, therefore, for smaller, lighter finishing equipment to incorporate into devices used by consumers at home or in retail environments. Furthermore, unlike offset presses which run a large number of copies of a single print job, digital printers can produce small numbers of copies of a job, requiring more frequent changes to the finishing sequence. In some cases, each printed page must be finished individually. Conventional folders, such as the RAPIDFOLD P7400 Desktop AutoFolder by MARTIN YALE, cannot finish each page individually without manual intervention. Moreover, the PL265 cutter can only store 10 cutting programs, so cannot produce more than 10 cut patterns without manual intervention. There is a need, therefore, for flexible and programmable finishing equipment that can finish each page individually without manual intervention.

As discussed in U.S. Pat. No. 7,095,526 to Housel, many dry electrophotographic print engines do not print full bleed, i.e. do not print to the edge of a sheet. This is because toner is not strongly attached to the sheet before fusing and can be disturbed by handling, reducing image quality.

U.S. Pat. No. 6,099,225 to Allen et al. describes finishing operations performed on a sheet-by-sheet basis using precision paper positioning and a transverse tool carrier. However, this scheme can waste paper due to trimming.

The CRICUT cutter by PROVO CRAFT can cut shapes into individual sheets of paper. However, the machine requires manual loading and unloading. Furthermore, the CRICUT moves the sheet to be cut back and forth during cutting, making it unsuitable for high-volume applications that need continuous-speed sheet transport.

Commonly-assigned U.S. Application Publication No. 2008/0159786 A1 describes printing raised information with a distinct tactile feel using electrophotographic techniques. Toner stack heights of at least 20 μm are provided.

There is a continuing need, therefore, for a way of cutting sheets in small, customizable finishers to produce booklets with flush edges.

SUMMARY OF THE INVENTION

Applicants have discovered that when thick toner stacks are used in the fold area of prints, they can produce non-flush edges in booklets. A thick toner stack adds space between adjacent nested sheets, causing an inner sheet to protrude from an otherwise-flush booklet edge.

In order to solve this problem, there is provided a method of producing a booklet, the booklet including an outer sheet and an inner sheet folded in a fold direction and nested together, each sheet having a respective thickness, the outer sheet having a length in a specific direction, and a fold axis of the outer sheet being defined in the center of the outer sheet in the specific direction, each sheet having an inside face and an outside face, wherein the inside face of the outer sheet is adjacent to the outside face of the inner sheet when the sheets are folded and nested, the method comprising:

printing a print image on the outside face of the inner sheet or the inside face of the outer sheet using a print engine, wherein the print image has a thickness;

using a processor to calculate a cut length in the specific direction of the inner sheet using the thicknesses of the sheets and the thickness of the print image, so that when the sheets are folded and the inner sheet is nested into the outer sheet, the edges of the inner sheet will not protrude beyond the edges of the outer sheet;

using a cutting device to cut the inner sheet to the calculated cut length in the specific direction, either before or after printing, so that a fold axis of the inner sheet is defined in the center of the inner sheet in the specific direction;

automatically folding the cut inner sheet and the outer sheet along their respective fold axes, wherein the cut inner sheet is folded after the printing step; and automatically nesting the printed sheets together to produce the booklet.

An advantage of this invention is that it uses small, light, inexpensive cutting and folding machinery that can be used in environments without enough space for prior-art machines, or that require unskilled operators be able to use the machinery. The invention can emit less audible noise while operating due to its reduced power draw. It can finish each sheet of a print job individually without manual intervention. In various embodiments, it reduces paper waste by cutting to length, thus obviating the requirement for separate trimming after cutting. It takes toner stack height into account to produce flush-edged booklets, even in the presence of thick toner stacks.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
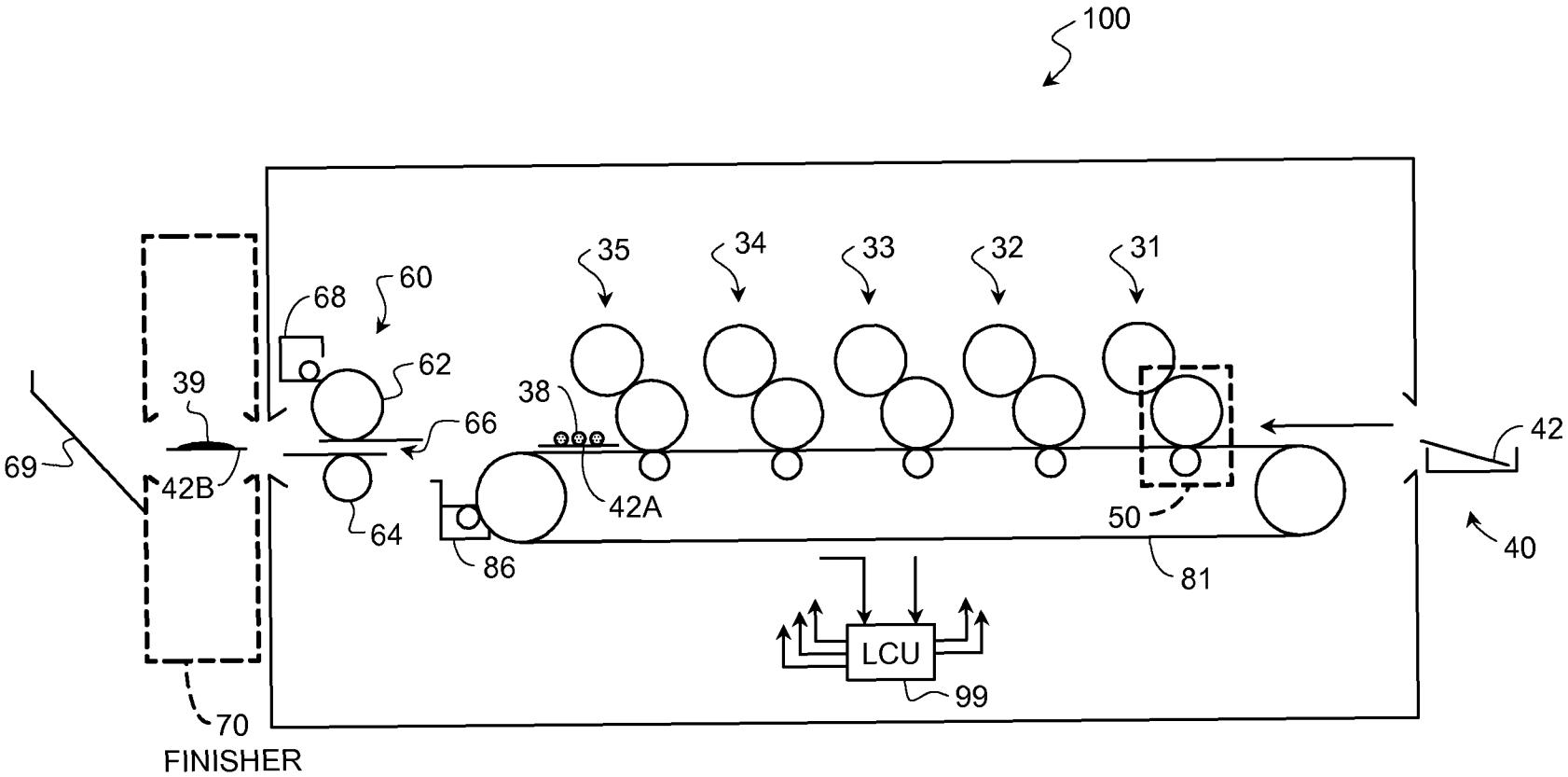
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

As used herein, the terms "parallel" and "perpendicular" have a tolerance of ±10°.

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, toner particles having a charge substantially opposite to the charge of the latent image are brought into the vicinity of the photoreceptor so as to be attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan or process direction. This is typically the vertical (Y) direction of a portrait-oriented receiver. The direction perpendicular to the slow-scan direction is referred to as the fast-scan or cross-process direction, and is typically the horizontal (X) direction of a portrait-oriented receiver. "Scan" does not imply that any components are moving or scanning across the receiver; the terminology is conventional in the art.

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g. precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles, and that can form an image, pattern, or coating when deposited on an imaging member including a photoreceptor, photoconductor, or electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g. particles containing colorants such as dyes or pigments), absorption of moisture or gasses (e.g. desiccants or getters), suppression of bacterial growth (e.g. biocides, particularly useful in liquid-toner systems), adhesion to the receiver (e.g. binders), electrical conductivity or low magnetic reluctance (e.g. metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture of toner and magnetic carrier particles, which can be electrically-conductive or -non-conductive. Toner particles can be magnetic or non-magnetic. The carrier particles can be larger than the toner particles, e.g. 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for the transfer to the receiver of individual print images. Of course, in other electrophotographic printers, each print image is directly transferred to a receiver.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-section showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to a receiver. The receiver is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, the receiver is advanced to a fuser 60, i.e. a fusing or fixing assembly, to fuse the print image to the receiver. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g. receiver 42B) carrying the fused image (e.g fused image 39) are transported in a series from the fuser 60 along a path either to a remote output tray 69, or back to printing modules 31 et seq. to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, by Peter S. Alexandrovich et al., and in U.S. Publication No. 2006/0133870, published on Jun. 22, 2006, by Yee S. Ng et al., the disclosures of which are incorporated herein by reference.

Figure 2:
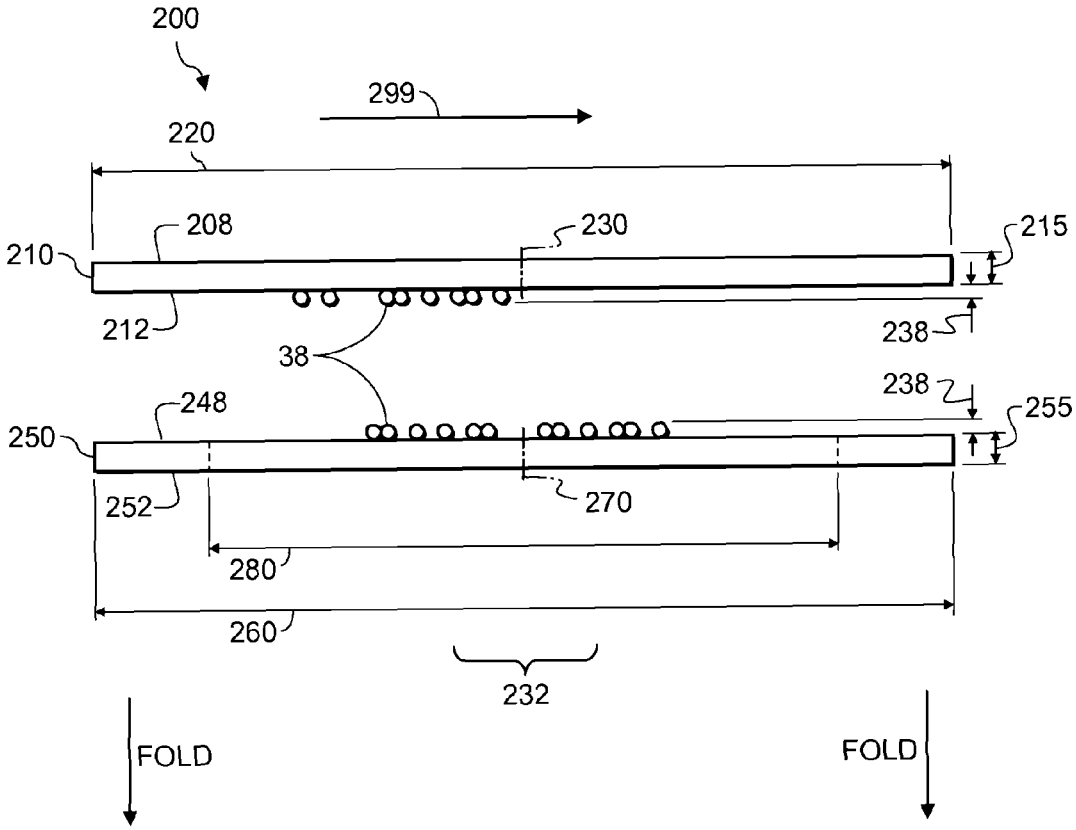
FIG. 2 is a cross-section of a booklet before folding.

FIG. 2 is a cross-section of a booklet before folding. Booklet 200 includes outer sheet 210 and inner sheet 250 nested together. Each sheet can be a receiver 42, as described above. Each sheet has a respective thickness 215, 255. The outer sheet 210 has a length 220 in a specific direction 299. A fold axis 230 of the outer sheet is defined in the center of outer sheet 210 in specific direction 299. Inner sheet 250 has a length 260 in the specific direction 299. Cut length 280 of inner sheet 250 in the specific direction 299 is calculated as described below using the thicknesses 215, 255 of the sheets. A fold axis 270 of inner sheet 250 is defined in the center of the inner sheet 250 in the specific direction 299 after cutting to cut length 280.

Figure 3:
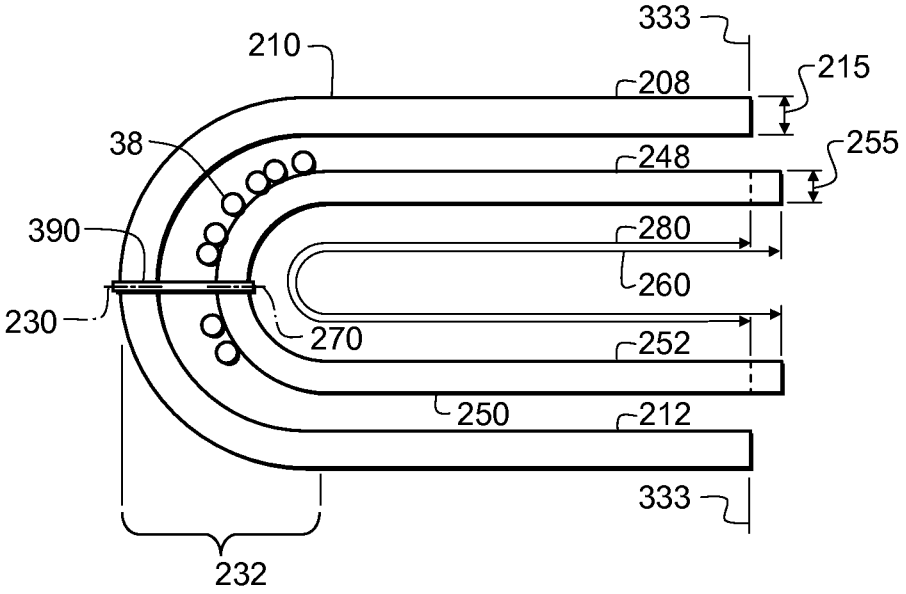
FIG. 3 is a cross-section of a booklet after folding.

The sheets will be folded in the direction marked "FOLD" to produce a booklet as shown in FIG. 3. Therefore, outer sheet 210 has an outside face 208, which will form the visible cover of the folded booklet, and an inside face 212. Inner sheet 250 has an inside face 248 and an outside face 252. Outside face 252 faces inside face 212. Print image 38 is printed on outside face 248 of inner sheet 250 or inside face 212 of outer sheet 210 using a print engine (e.g. printing module 31 of FIG. 1). In this example, print images 38 are shown on outside face 248 and inside face 212, but an image can be applied to only one or the other. Each print image 38 has a thickness 238. Thickness 238 can be calculated as the average or maximum thickness of toner over the surface of the entire print image, or preferably as the average or maximum thickness of toner over fold area 232. Fold area 232, for each sheet, is the area on either side of fold axes 230, 270 that experiences plastic deformation or cracking while the respective sheet is folded.

In an embodiment, outer sheet 210 is a cover sheet and inner sheet 250 is a sheet of content. Outer sheet 210 is thicker and stiffer than inner sheet 250.

FIG. 3 is a cross-section of a booklet after folding. Booklet 200 with outer sheet 210, inner sheet 250, respective thicknesses 215, 255, respective fold axes 230, 270, respective inside faces 212, 252, and respective outside faces 208, 248 are as shown in FIG. 2. Outside face 248 of inner sheet 250 is shown carrying print image 38, which can be formed electrophotographically as described above (so inner sheet 250 carries fused image 39), by wet electrophotography, by inkjet printing, by thermal dye sublimation, or by other digital printing technologies known in the art. As discussed above, inside face 212 of outer sheet 210 can also carry a print image 38 (or a fused image 39). Outer sheet 210 and inner sheet 250 are held together by staple 390, which passes through both sheets.

Outer sheet 210 has a known thickness 215. Upon folding, there are formed an acute angle on the inner surface of outer sheet 210 along fold axis 230, and an obtuse angle on the outer surface of inner sheet 250 along fold axis 270. Thicknesses 215, 255 of outer sheet 210 and inner sheet 250 cause inner sheet 250 of similar dimensions to protrude from outer sheet 210 at edge 333, which is opposite fold axis 230 when folded.

After folding, inner sheet 250 has a narrower radius of curvature at fold axis 270 than does outer sheet 210 at fold axis 230. Therefore, less of length 260 of inner sheet 250 is taken up in the curvature at the fold (in fold area 232), so more of length 260 is taken up in the pages outside fold area 232. Moreover, print image 38 increases the minimum spacing between inner sheet 250 and outer sheet 210 by serving as spacers or standoffs. Inner sheet 250 therefore protrudes beyond edge 333. Cutting inner sheet 250 to cut length 280 causes the edges of inner sheet 250 to be flush with the edges of outer sheet 210 at edge 333.

Figure 4:
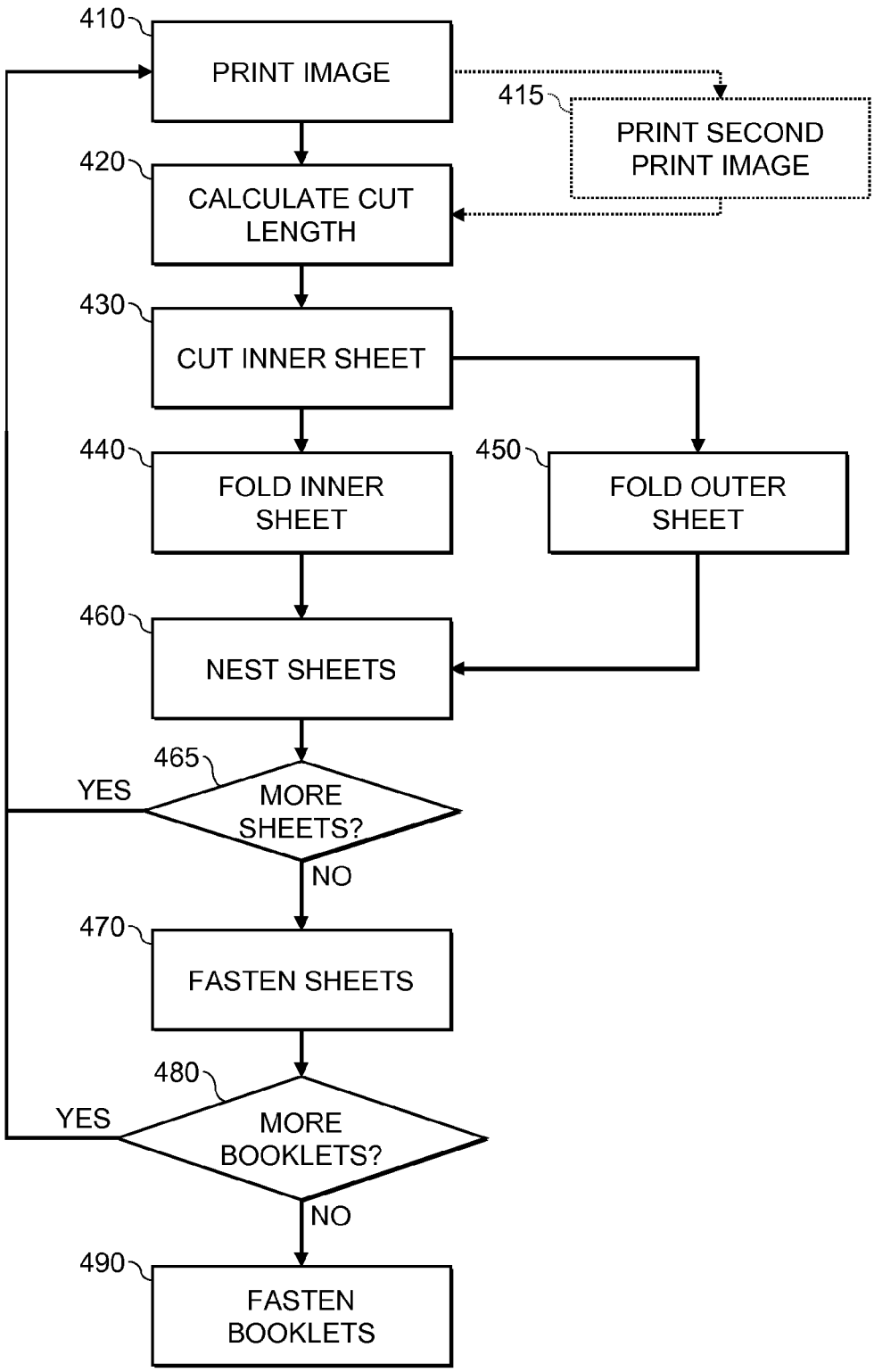
FIG. 4 is a flowchart of a booklet-making method according to an embodiment of the present invention.

FIG. 4 is a flowchart of a booklet-making method according to an embodiment of the present invention. Referring also to FIG. 2, processing begins with step 410, in which print image is printed on inner sheet 250 using a print engine after cutting inner sheet 250 in step 420. A separate print image can also be printed on outer sheet 210, e.g. a cover image for a magazine. print image 38 (FIG. 3) is printed on outside face 248 of inner sheet 250 or inside face 212 of outer sheet 210 using a print engine (e.g. printing module 31 of FIG. 1). The print image has a thickness 238, as discussed above. Step 410 is followed by step 420 and optionally by step 415.

In an embodiment, print image 38 is printed on inner sheet 250 or outer sheet 210 by applying toner particles to the corresponding sheet. The toner particles preferably compose dry toner. In another embodiment, the print image is printed on inner sheet 250 or outer sheet 210 by applying an adhesive to the corresponding sheet. Adhesives can include wood glue, paste, and toner formulated to be used as glue. Toner used as glue is described in Japanese publication number Hei 9-110051, published Apr. 28, 1997, Print image 38 can include high- or low-spatial-frequency content; for example, it can be a 1200 dpi image or a 2 $in^2$ solid fill.

In optional step 415, a second print image is printed, so that respective print images are printed on inside face 212 of outer sheet 210 and on outside face 248 of inner sheet 250. Each print image 38 has a thickness 238, and the thicknesses of the print images on the two faces can be the same or different. Step 415 is followed by step 420.

In step 420, a processor is used to calculate cut length 280 in specific direction 299 of inner sheet 250 using the thicknesses 215, 255 of the sheets 210, 250 and the thickness(es) 238 of the print image(s) 38, so that when the sheets 210, 250 are folded and inner sheet 250 is nested into outer sheet 210, the edges of inner sheet 250 will not protrude beyond the edges of outer sheet 210. This is discussed further below. Step 420 is followed by step 430.

When step 415 has been performed, the processor calculates cut length 280 using the thicknesses 238 of the print images 38 on inside face 212 of outer sheet 210 and on outside face 248 of inner sheet 250. This permits accurate calculation for duplex prints, or simplex prints in which one print is flipped before nesting. For example, outer sheet 250 and inner sheet 210 can be printed simplex, then inner sheet 210 can be flipped so that its face that carries print image 38 is adjacent to the face of outer sheet 250 carrying its print image 38.

In step 430, a cutting device (e.g. cutting device 520 of FIG. 5) is used to cut inner sheet 250 to calculated cut length 280 in specific direction 299. This can be performed either before or after printing. In this way fold axis 270 of inner sheet 250 is defined in the center of inner sheet 250 in specific direction 299. Step 430 is followed by steps 440 and 450.

In steps 440 and 450, the cut inner sheet 250 and outer sheet 210 are automatically cut along their respective fold axes 270, 230. The cut inner sheet 250 is folded after the corresponding printing step (410 or 415). Steps 440 and 450 are followed by step 460. Inner sheet 250 can be cut before or after printing.

In step 460, the printed sheets 210, 250 are automatically nested together to produce the booklet 200. Step 460 is followed by decision step 465.

Decision step 465 decides whether there are more sheets to include in this booklet. If so, the next step is step 410. If not, the next step is step 470. In this way, the printing through nesting steps are repeated to produce a booklet having more than two sheets. In step 420, a respective cut length 280 is calculated for each sheet depending on the position of the sheet within the booklet. For example, cut length 280 can become shorter as more sheets are nested inside the booklet, if nesting proceeds from the outermost sheet to the innermost sheet. This is because sheets closer to the center have more sheets, and therefore more thickness, between their fold edges and the fold edge of the outermost sheet. They therefore stick out more past edge 333 (FIG. 3) than sheets closer to the outermost sheet, and so need to be trimmed more, and thus have a shorter cut length 280.

In step 470, the nested sheets are fastened together to form a bound booklet. Sheets can be fastened using stapling, saddle-stitching, sewing, gluing, or other methods known in the art. Step 470 is followed by decision step 480.

Decision step 480 decides whether more booklets (e.g. signatures) are to be produced. If so, the next step is step 410. If not, the next step is step 490. In this way, the printing through nesting steps are repeated to produce a plurality of booklets. Decision step 480 is followed by step 490, in which the plurality of booklets are assembled to form a book.

In embodiments producing multiple booklets, each sheet is cut depending upon the position of the booklet within the book. This is discussed further below with reference to FIG. 6.

In various embodiments, these steps can be performed in various orders. For example, several sheets can be stacked before folding and folded together so that the result of the folding is a nested booklet. Cutting, printing, folding, stacking, nesting, and fastening can be ordered as desired, and can be performed for one sheet or more than one sheet at a time, as long as step 440 takes place after the corresponding printing step (410 or 415).

Figure 5:
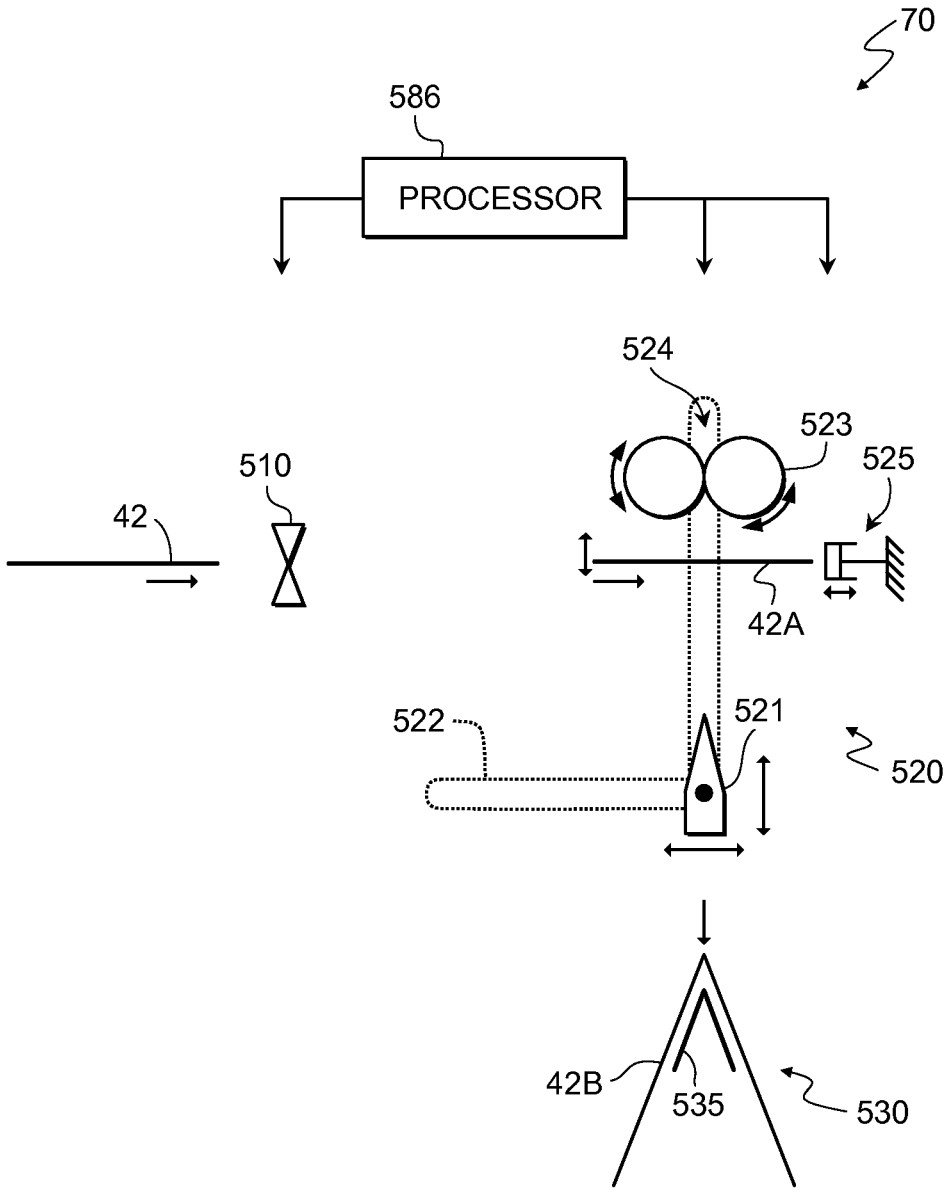
FIG. 5 is an elevation of a booklet-making apparatus according to an embodiment of the present invention.

FIG. 5 is an elevation of a booklet-making apparatus according to an embodiment of the present invention. As shown in FIG. 1, printing module 31 deposits print image 38 on receiver 42A. Fuser 60 fuses print image 38 into fused image 39, shown on receiver 42B. Finisher 70 includes cutting device 510, folder 520, nester 530, and processor 586. Referring back to FIG. 4, cutting device 510 is adapted to perform step 420, folder 520 is adapted to perform steps 440 and 450, and nester 530 is adapted to perform step 460. Processor 586 is a general-purpose processor, CPU, FPGA, PLD, PAL, or ASIC programmed to sequence the operations of the finisher and provide control signals to its components.

Cutting device 510 is a guillotine, electronic scissors, pizza cutter, laser cutter, spiked-wheel perforator, or other cutting device for cutting receiver 42 to length.

Folder 520 includes blade 521 riding in track 522 to press receiver 42A into rollers 523. Receiver 42A is positioned under rollers 523 and held in place by a belt, transport roller, vacuum chuck or other retention mechanism. Adjustable paper stop 525 positions the center of receiver 42A (e.g. fold axis 270 of inner sheet 250) over the point of blade 521. Blade 521 slides up track 522 and presses receiver 42A into nip 524 formed between rollers 523. Rollers 523 rotate to take up receiver 42A into nip 524, so that receiver 42A is folded by being pinched and creased between rollers 523. Blade 521 then rides back down track 522 and to the left so that it is no longer under nip 524 of rollers 523. Rollers 523 reverse direction and receiver 42A falls out of the folder.

Nester 530 includes holder 535, which is positioned below nip 524 of rollers 523 and has a spine with an angle less than 180° extended along a line parallel to the fold axis of receiver 42A. When receiver 42A falls out of rollers 523, since blade 531 is out of the way, receiver 42A falls onto holder 535. This is shown as receiver 42B; the size of receiver 42B is exaggerated to more clearly show the invention.

In various embodiments, processor 586 causes paper stop 525 to be positioned so that the leading edge (here, the right-hand edge) of receiver 42A is stopped at the appropriate position relative to the center of receiver 42A and to the centerline of blade 521. For example, to fold inner sheet 250, paper stop 525 is positioned so that the leading edge of inner sheet 250 stops at a position equal to the centerline of blade 521 (extended through receiver 42A) plus one-half of cut length 280. This positions fold axis 270 of inner sheet 250 on the extended centerline of blade 521, above blade 521 and below nip 524. When blade 521 travels up, it contacts inner sheet 250 (here, receiver 42A) at fold axis 270, folding inner sheet 250 in the desired location.

Cutting device 510, blade 521, rollers 523, and paper stop 525 are driven by motors, e.g. servo motors or stepper motors, or actuators, e.g. linear piezoelectric actuators or solenoids (not shown), which can be selected by those skilled in the art, and can be belt- or chain-driven. Processor 586 provides control signals to the motors, as indicated by the arrows on the figure. Processor 586 can be part of LCU 99 or a separate processor.

Figure 6:
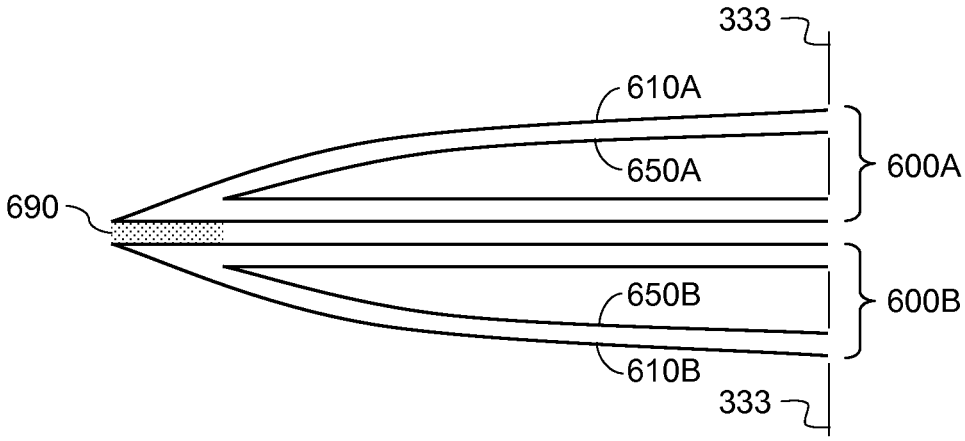
FIG. 6 is an elevational cross-section of multiple booklets according to an embodiment of this invention.

FIG. 6 is an elevational cross-section of multiple booklets (e.g. multiple signatures, or a magazine and an advertising supplement) according to an embodiment of this invention. Booklets 600A and 600B are held together by fastener 690 to form a book. Fastener 690 can be glue, a staple, a stitch, or another fastener. Booklet 600A includes outer sheet 610A and inner sheet 650A. Booklet 600B includes outer sheet 610B and inner sheet 650B. As shown, fastening the spines of booklets 600A, 600B together pulls the pages of the booklets out of alignment. To keep the booklets flush at edge 333, cut lengths 280 are calculated taking this effect into account. Specifically, cut lengths 280 are affected by, and so calculated as a function of, the position of the booklet within the book in addition to the position of the sheet within the booklet. For three booklets fastened together to form a book, the cut lengths are shorter (i.e. more is cut off) in the center booklet than in the two booklets at the edges. This is because fastener 690 pulls the edge booklets in towards the center booklet, pulling back the pages of the edge booklets farther than the pages of the center booklet. This effect can be measured on physical prototypes of the books in question, and a lookup table can be computed to provide the cut length 280 for a sheet given its relative position in its booklet and in the book.

Figure 7:
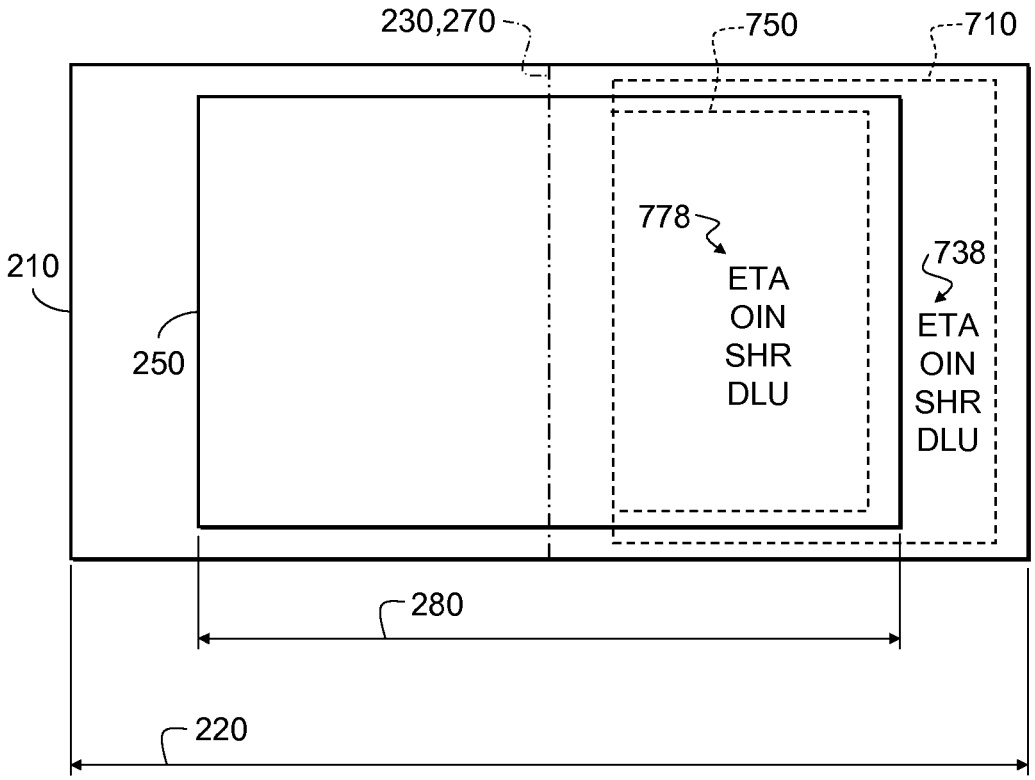
FIG. 7 is a plan view of print areas on printed sheets according to various embodiments of the present invention.

FIG. 7 is a plan view of print areas on printed sheets according to various embodiments of the present invention. Outer sheet 210 and inner sheet 250 are shown disposed over each other so that fold axis 230 and fold axis 270 are coincident. For clarity, only the image to the right-hand side of the fold axis is shown; a corresponding image can be produced on the left-hand side of the fold axis. Also for clarity, the sheets are shown having different widths, but they can have the same width (e.g. for printing a magazine).

In various embodiments, printing step 430 (FIG. 4) includes determining a print area 710, 750 on each sheet 210, 250 (respectively) based on the length 220 of the outer sheet 210 and the calculated cut length 280 of the inner sheet 250, and printing respective print images 738, 778 in the respective print areas 710, 750 on outer sheet 210 and inner sheet 250, so that print area 750 of inner sheet 250 is smaller than print area 710 of outer sheet 710. That is, print area 750 has a lower area, length, or width than print area 710. This advantageously maintains a constant gutter (inner margin) space, permitting binding without having to take variable gutter space into account.

Figure 8:
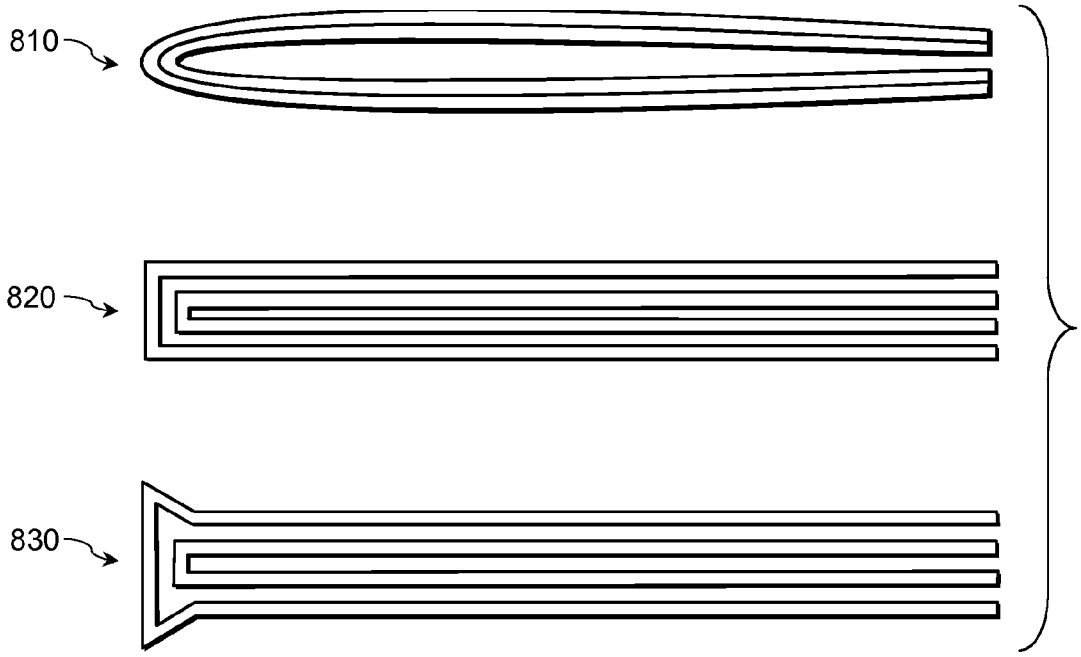
FIG. 8 shows elevational cross-sections of various booklet spine shapes useful with the present invention.

FIG. 8 shows elevational cross-sections of various booklet spine shapes useful with the present invention. Spine shape 810 is a rounded spine, e.g. for a saddle-stitched booklet. Spine shape 820 is a squared spine, useful for producing the look of perfect binding without requiring a perfect-binding machine. Spine shape 830 is a spine that bulges out at the end, here in an angular fashion, although a rounded or mushroom-shaped bulge can be produced. The bulge permits easier gripping of the booklet, and permits the booklet to lie more flat when opened. Other spine shapes can also be employed.

Referring also to FIG. 2, in various embodiments, the folding steps 440, 450 (FIG. 4) apply a selected spine shape (e.g. 810, 820, 830) to the inner sheet 250 and the outer sheet 210, respectively. Cut length 280 is calculated based on the spine shape. Each spine shape has a different mapping of sheet position in the booklet to cut length 280. For example, the difference in lengths between sheets can be smaller using spine shape 810 than using spine shape 820, because when using spine shape 820, the outer sheets have to travel two sides of a triangle instead of (approximately) its hypotenuse.

Figure 9:
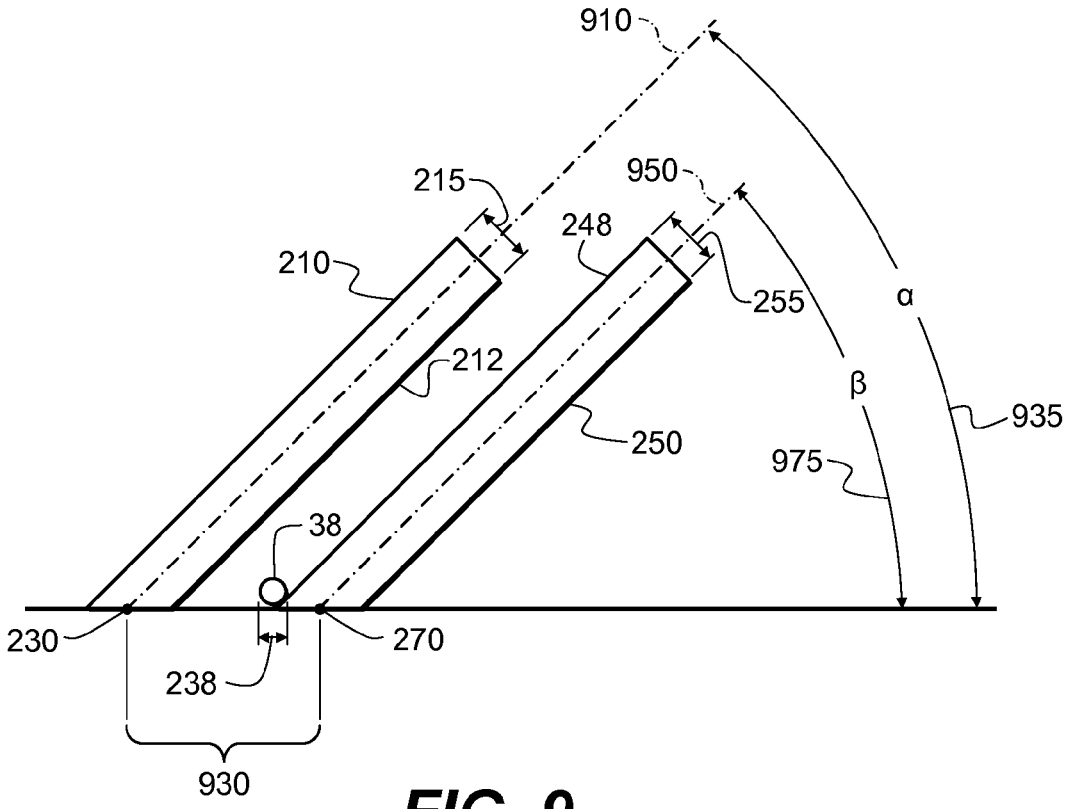
FIG. 9 shows a cut-length calculation according to an embodiment of the present invention.

FIG. 9 shows an elevational cross-section of folded and nested sheets and a corresponding cut-length calculation (FIG. 4 step 410) according to an embodiment of the present invention. This figure shows a booklet having spine shape 810 (FIG. 8); corresponding diagrams can be drawn for other spine shapes by those skilled in the geometrical art. This discussion assumes sheets have constant thickness; variable-thickness calculations can be performed by those skilled in the art.

Portions of the top halves of outer sheet 210 and inner sheet 250 are shown after folding and nesting. The portion chosen is small enough that each sheet can be approximated as a rectangular prism, and thus as a rectangle in this cross-section. The longitudinal axis of the rectangle representing outer sheet 210 is axis 910; axis 950 likewise corresponds to inner sheet 250. Thicknesses $t_o$ 215, $t_i$ 255 and fold axes 230, 270 are as shown in FIG. 3. Angle 935, denoted $\alpha$, is the angle between the horizontal and axis 910 of outer sheet 210. Angle 975, denoted $\beta$, is the angle between the horizontal and axis 950 of inner sheet 250. Spacing 930 is to be calculated.

Inside face 212 of outer sheet 250 and outside face 248 of inner sheet 250 are shown. In this example, outside face 248 carries print image 38 having thickness $t_p$ 238.

The minimum value of spacing s 930 is the portions of the sheets between axes 910 and 950, plus thickness 238. That is, the sheets can be in mechanical contact at one or more points, as closely as the intervening print image 38 will permit. Spacing 930 can be larger by introducing an air gap in between the sheets. The portion $s_o$ of outer sheet 210 on the side of axis 910 closer to inner sheet 250 is $$s_o = \frac{t_o/2}{\cos(\pi/2-\alpha)} \quad \text{(Eq. 1)}$$

Correspondingly, the portion $s_i$ of inner sheet 250 on the side of axis 950 closer to outer sheet 210 is $$s_i = \frac{t_i/2}{\cos(\pi/2-\beta)} \quad \text{(Eq. 2)}$$

The minimum value of spacing s 930 is $s_o+t_p+s_i$.

Spacing s 930 is approximately the smallest amount by which each end of inner sheet 250 protrudes beyond the corresponding edge of outer sheet 210 if the sheets 210, 250 fold and lay the same way when nested and have approximately the same composition and structure. If outer sheet 210 is more curved than inner sheet 250, inner sheet 250 will protrude farther than s. If inner sheet 250 is corrugated at some point along its length and outer sheet 210 is not, inner sheet 250 can protrude not at all, or be recessed behind outer sheet 210.

Referring also to FIG. 2, in embodiments in which spacing s 930 is the amount by which each end of inner sheet 250 protrudes beyond the corresponding edge of outer sheet 210, cut length 280 of inner sheet 250 is calculated as length L 260 minus 2×s, which equals $L-2\times(s_o+t_p+s_i)$ if there is no gap between the sheets 210, 250 other than that provided by the print image. In other embodiments, cut length 280 is calculated as $L-(2\times s+\delta)=L-[2\times(s_o+t_p+s_i)+\delta]$, where $\delta$ is a correction factor determined based on the spacing between sheets, the relative positions of the sheets within the booklet, or the curvature of the sheets in the booklet.

Figure 10:
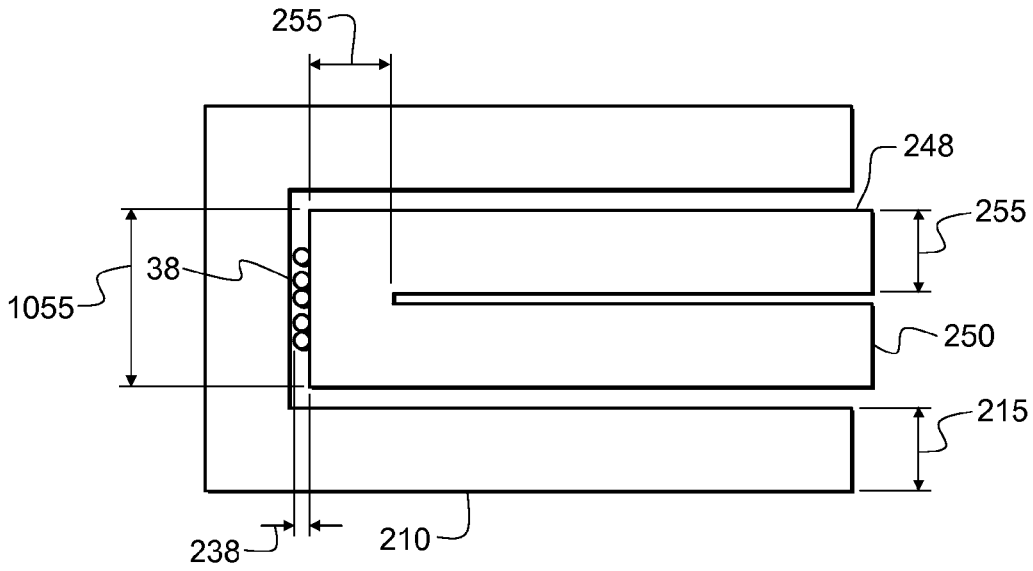
FIG. 10 shows a cut-length calculation according to another embodiment of the present invention.

FIG. 10 shows an elevational cross-section of folded and nested sheets and a corresponding cut-length calculation (FIG. 4 step 410) according to another embodiment of the present invention. This figure shows a booklet having spine shape 820 (FIG. 8), a squared-off edge, and assumes there is no gap between the sheets.

Outside face 248 of inner sheet 250 are shown. In this example, outside face 248 carries print image 38 having thickness $t_p$ 238.

Inner sheet 250 has thickness $t_i$ 255 and is doubled over on itself, forming a mass of thickness $2\times t_i$ 1055. Outer sheet 210 has thickness $t_o$ 215 and wraps around the mass, so has a length of paper in the spine $\geqq 2\times t_i+2\times t_o$. The print image adds thickness $t_p$ to each side of the fold. Moreover, spacing $s\geqq t_i/2+t_o/2$. Therefore, cut length l 280 of inner sheet 250 is calculated as $$l = L - \lfloor (t_i/2 + t_o/2) + (2t_i + 2t_o) + t_p + \delta \rfloor \quad \text{(Eq. 3A)}$$

$$= L - \left[\frac{5(t_i + t_o)}{2} + t_p + \delta\right] \quad \text{(Eq. 3B)}$$

for correction factor $\delta$ and length L 280 as described above.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B, 42C receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
200 booklet
208 outside face
210 outer sheet
212 inside face
215 thickness
220 length

230 fold axis
232 fold area
238 thickness
248 outside face
250 inner sheet
252 inside face
255 thickness
260 length
270 fold axis
280 cut length
299 direction
333 edge
390 staple
410 step
415 step
420 step
430 step
440 step
450 step
460 step
465 decision step
470 step
480 decision step
490 step
510 cutting device
520 folder
521 blade
522 track
523 rollers
524 nip
525 paper stop
530 nester
535 holder
586 processor
600A, 600B booklet
610A, 620B outer sheet
650A, 650B inner sheet
690 fastener
710 print area
738 print image
750 print area
778 print image
810, 820, 830 spine shape
910 axis
930 spacing
935 angle
950 axis
975 angle
1055 thickness

The invention claimed is:

1. A method of producing a booklet, the booklet including an outer sheet and an inner sheet folded in a fold direction and nested together, each sheet having a respective thickness, the outer sheet having a length in a specific direction, and a fold axis of the outer sheet being defined in the center of the outer sheet in the specific direction, each sheet having an inside face and an outside face, wherein the inside face of the outer sheet is adjacent to the outside face of the inner sheet when the sheets are folded and nested, the method comprising:

printing a print image on the outside face of the inner sheet or the inside face of the outer sheet using a print engine;

calculating a thickness for the print image;

using a processor to calculate a cut length in the specific direction of the inner sheet using both at least a known thickness of the outer sheets and the calculated thickness of the print image, so that when the sheets are folded and the inner sheet is nested into the outer sheet, the edges of the inner sheet will not protrude beyond the edges of the outer sheet;

using a cutting device to cut the inner sheet to the calculated cut length in the specific direction, either before or after printing, so that a fold axis of the inner sheet is defined in the center of the inner sheet in the specific direction;

automatically folding the cut inner sheet and the outer sheet along their respective fold axes, wherein the cut inner sheet is folded after the printing step; and automatically nesting the printed sheets together to produce the booklet.

2. The method according to claim 1, further including printing respective print images on the inside face of the outer sheet and on the outside face of the inner sheet, wherein each print image has a thickness, and wherein the cut length is calculated using the thicknesses of the print images on the inside face of the outer sheet and on the outside face of the inner sheet.

3. The method according to claim 1, wherein the print image is printed on the inner or outer sheet by applying toner particles to the corresponding sheet.

4. The method according to claim 1, wherein the print image is printed on the inner or outer sheet by applying an adhesive to the corresponding sheet.

5. The method according to claim 1, further including repeating the printing through nesting steps to produce a booklet having more than two sheets, wherein each sheet is cut depending on its position within the booklet.

6. The method according to claim 1, further including repeating the printing through nesting steps to produce a plurality of booklets, and assembling the plurality of booklets to form a book, wherein the sheet is cut depending upon the position of the booklet within the book.

7. The method according to claim 1, wherein the printing step further includes determining a respective print area on each sheet based on the respective lengths of the sheets, and printing respective print images in the respective print areas on the inner and the outer sheets, so that the print area of the inner sheet is smaller than the print area of the outer sheet.

8. The method according to claim 1, further including applying a selected spine shape to the inner sheet and the outer sheet, and wherein the cut length is calculated based on the spine shape.

9. The method as in claim 1, wherein the thickness of the print image is calculated as an average thickness of toner over a surface of the entire print image or as an average or maximum thickness of toner over a fold area.

* * * * *